US010294702B1

(12) United States Patent
Skiles

(10) Patent No.: US 10,294,702 B1
(45) Date of Patent: May 21, 2019

(54) "SKILES LOCKING SYSTEM" S.L.S

(71) Applicant: Brisbin Marvin Skiles, Panama City, FL (US)

(72) Inventor: Brisbin Marvin Skiles, Panama City, FL (US)

(73) Assignee: Brisbin Marvin Skiles, Panama City, FL (US)

( * ) Notice: Subject to any disclaimer, the term of this patent is extended or adjusted under 35 U.S.C. 154(b) by 0 days.

(21) Appl. No.: 14/145,937

(22) Filed: Jan. 1, 2014

(51) Int. Cl.

| | |
|---|---|
| ***E05C 1/06*** | (2006.01) |
| ***E05C 1/12*** | (2006.01) |
| *E05C 9/00* | (2006.01) |
| *E05C 1/00* | (2006.01) |
| *E05C 9/10* | (2006.01) |
| *E05C 1/04* | (2006.01) |
| *E05C 1/10* | (2006.01) |
| *E05C 1/02* | (2006.01) |

(52) U.S. Cl.
CPC ..... *E05C 1/12* (2013.01)

(58) Field of Classification Search
CPC ..... E05C 1/12; E05C 9/04; E05C 9/06; E05C 9/063; E05C 9/043; E05C 9/046; E05C 9/08; E05C 9/20; E05C 3/34; E05C 9/028; E05C 65/0003; E05C 9/00; E05B 63/14; E05B 53/003; E05B 53/005; E05B 15/04; E05B 63/20
USPC ..... 292/113, 32, 33, 37, 38, 42, 137, 163, 292/138, 169.11–169.21; 70/1.5, 1.7, 70/422, 131
See application file for complete search history.

(56) References Cited

U.S. PATENT DOCUMENTS

| | | | | | |
|---|---|---|---|---|---|
| 609,197 | A | * | 8/1898 | Fries | 292/36 |
| 636,325 | A | * | 11/1899 | Eyster | 70/114 |
| 1,179,731 | A | * | 4/1916 | McDonald | 292/39 |
| 1,366,015 | A | * | 1/1921 | Morris | 70/114 |
| 1,480,104 | A | * | 1/1924 | Palmer | 70/1.7 |
| 1,495,820 | A | * | 5/1924 | Tierney | 70/108 |
| 1,514,593 | A | * | 11/1924 | Seessengood | 70/1.5 |

(Continued)

OTHER PUBLICATIONS

U.S. Appl. No. 08/515,993, filed Aug. 1995, Donaldson, Edward M.*

*Primary Examiner* — Kristina R Fulton
*Assistant Examiner* — Faria F Ahmad
(74) *Attorney, Agent, or Firm* — Ariel S. Bentolila; Bay Area IP Group, LLC

(57) ABSTRACT

Skiles Locking System enables automatic actuation of multiple deadbolt type locks instantly through use of remote wireless activator, key, or lock button. (inside of dwelling) This is accomplished through a mechanized assembly completely contained inside door. Attached to door knob shaft located in the center of the door, a rotating disc and wire assembly retracts internal spring loaded deadbolts from bolt sleeves in door frame allowing ingress or egress. When the door shuts, beveled internal spring-loaded bolts move back into door frame, allowing locking of door with multiple deadbolt type locks with remote wireless activator, key, or lock button (inside). No manual sliding of deadbolts needed. The system also incorporates brass "weak-link" locking pins, which attach steel connecting wires to rotating disc. These "weak-links" break upon abnormal pressure when door knob mechanism is compromised by force, permanently locking door in place. The system allows for keyed or electronic keyless entry.

17 Claims, 13 Drawing Sheets

(56) References Cited

U.S. PATENT DOCUMENTS 1,548,907 A * 8/1925 Schweim ..... 292/62
1,550,953 A * 8/1925 Dillon ..... 70/1.5
1,556,434 A * 10/1925 Fowler ..... E05B 65/0082 292/2
1,567,811 A * 12/1925 Murphy ..... 70/114
1,598,964 A * 9/1926 Fowler ..... 70/1.5
1,607,068 A * 11/1926 Fowler ..... 70/1.5
1,634,933 A * 7/1927 Dalton ..... 70/113
1,697,950 A * 1/1929 Dexter ..... E05C 1/163 292/169.19
1,744,707 A * 1/1930 De Castro ..... 70/303 R
1,786,975 A * 12/1930 Miller ..... 70/1.5
1,791,996 A * 2/1931 Ailes ..... 70/1.7
1,797,747 A * 3/1931 Ailes ..... E05G 1/12 109/30
1,909,697 A * 5/1933 Macbeth ..... E05B 13/004 292/150
2,066,705 A * 1/1937 Vazquez ..... 70/118
2,486,460 A * 11/1949 Bonenberger ..... 292/34
2,690,144 A * 9/1954 Ellis et al. ..... 109/59 R
2,823,536 A * 2/1958 Watson ..... 70/1.5
2,947,160 A * 8/1960 Wolters ..... 70/1.5
3,076,420 A * 2/1963 McClellan ..... E05B 65/0082 109/38
3,088,548 A * 5/1963 Behrens et al. ..... 187/331
3,617,080 A * 11/1971 Miller ..... 292/38
3,637,277 A * 1/1972 Krug et al. ..... 312/217
3,735,714 A * 5/1973 Shoop ..... 109/59 R
4,012,066 A * 3/1977 Salvatore ..... E05B 65/104 292/341.13
4,046,410 A * 9/1977 Connell ..... 292/36
4,114,933 A * 9/1978 Jankelewitz ..... E05C 9/06 292/37
4,131,769 A * 12/1978 Davis ..... 379/445
4,199,176 A * 4/1980 Kelly ..... E05C 9/063 292/141
4,263,795 A * 4/1981 Van Gompel ..... 70/99
4,266,488 A * 5/1981 Markham ..... 109/59 R
4,288,944 A * 9/1981 Donovan ..... 49/395
4,446,709 A * 5/1984 Steinbach ..... 70/496
4,502,720 A * 3/1985 Fayerman ..... E05B 65/104 292/169.16
4,534,192 A * 8/1985 Harshbarger et al. ..... 70/118
4,672,829 A * 6/1987 Gater et al. ..... 70/472
4,739,584 A * 4/1988 Zellman ..... E05F 15/668 292/38
4,999,949 A * 3/1991 Granlund ..... 49/383
5,040,652 A * 8/1991 Fish et al. ..... 70/189
5,096,238 A * 3/1992 Mintz ..... 292/35
5,394,718 A * 3/1995 Hotzl ..... 70/283.1
5,472,246 A * 12/1995 Puric ..... 292/36
5,595,408 A * 1/1997 Jeche ..... 292/37
5,603,534 A * 2/1997 Fuller ..... 292/2
5,704,234 A * 1/1998 Resch ..... 70/371
5,794,467 A * 8/1998 Justice ..... 70/118
5,829,360 A * 11/1998 Rench et al. ..... 105/355
5,911,763 A * 6/1999 Quesada ..... 70/120
5,992,188 A * 11/1999 Saunders ..... 70/120
6,592,155 B1 * 7/2003 Lemley et al. ..... 292/7
6,957,513 B2 * 10/2005 Pettit ..... E05B 5/003 292/141
7,048,311 B2 * 5/2006 Sawatani et al. ..... 292/33
7,207,406 B1 * 4/2007 Polz ..... B60R 21/34 180/274
7,591,157 B2 * 9/2009 O'Neill et al. ..... 70/118
7,686,354 B2 * 3/2010 Jasper ..... 292/33
7,775,564 B2 * 8/2010 Moore ..... 292/37
7,966,852 B1 * 6/2011 Huang ..... 70/379 R
8,276,527 B2 * 10/2012 Stepp ..... 109/64
8,459,702 B2 * 6/2013 Bourgain et al. ..... 292/32
8,469,408 B2 * 6/2013 Li ..... 292/37
8,534,719 B2 * 9/2013 Chow ..... 292/175
8,701,817 B2 * 4/2014 Schoen ..... E05B 77/04 180/281
8,943,864 B2 * 2/2015 Rasmussen et al. ..... 70/222
2003/0057718 A1 * 3/2003 Stoehr ..... E05B 15/0205 292/340
2004/0139773 A1 * 7/2004 Chang ..... 70/416
2007/0084259 A1 * 4/2007 Bellamy et al. ..... 70/278.7

* cited by examiner

"SKILES LOCKING SYSTEM" S.L.S

CROSS-REFERENCES TO RELATED APPLICATIONS

Kwikset Corporation—U.S. Pat. No. 4,672,829, Date June 1987

Kwikset Corporation—US-2014157842A1, Date June 2014

Saunders, John A.—U.S. Pat. No. 5,992,188, Date November 1999

Donaldson, Edward M. —U.S. Ser. No. 08/515,993, Date August 1995

STATEMENT REGARDING FEDERAL SPONSORED RESEARCH OR DEVELOPMENT

Not Applicable

NAMES OF THE PARTIES TO A JOINT RESEARCH

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

(1) Field of the Invention: Technical Field

The Skiles Locking System, S. L. S. incorporates the existing Kwikset tubular locking cylinder in its operation. The S. L. S. Locking System utilizes multiple internal spring loaded sliding bolts and also multiple internal spring loaded floating locks within the spring loaded sliding bolts. The S. L. S. rotating discs which are attached to the Kwikset tubular locking cylinder operate independently of each other yet, are located on the same Kwikset tubular locking cylinder.

(2) Background Art

The Skiles Locking System, S. L. S. incorporates the existing Kwikset tubular locking cylinder in its operation. The S. L. S. Locking System utilizes multiple internal spring loaded sliding bolts and also multiple internal spring loaded floating locks within the spring loaded sliding bolts, unlike the Kwikset tubular system.

The door (FIG. 5) is easily closed and locked just by pushing the door on its hinges (FIG. 5) into its frame, and activating the singular door lock mechanism from either "inside or outside" of the dwelling unlike Saunders, which can only be manually activated and locked once inside. In the S. L. S. Locking System, rotating the doorknob (FIG. 1) is not necessary to activate the S. L. S. Locking System as is required in the "Saunders System." This unique feature of the S. L. S. Locking System (FIG. 1) enables multiple internal spring loaded bolts (FIGS. 2 & 3) within the door (FIGS. 3 & 5) to be activated immediately and simultaneously after closure of the door (FIG. 5) creating a safe, secure and defended position for the occupants without having to activate "additional locks," dead bolts or keyed mechanisms in the door, saving precious seconds and possibly lives in the process.

BRIEF SUMMARY OF THE INVENTION

A mechanized system of multiple internal spring loaded sliding bolts and internal spring loaded floating lock mechanisms located inside of the door. The S. L. S. Skiles Locking System protects the occupants and their property from unwanted intruders, harm and theft. These internal spring loaded sliding bolts and their internally located spring loaded floating locks are interconnected with and to a centrally positioned door knob mechanism and to the S. L. S. rotating discs which allow activation of the locking system mechanism either "inside or outside" of the dwelling into the locked or unlocked position. The S. L. S. Skiles Locking System is also activated inside or outside of the dwelling with either a key, "button" (inside) or "electronic keyless entry device," allowing the door to be unlocked and opened. This can be done from either side of the door, (inside or outside) unlike the Saunders locking system, which allows operation only from the inside. The same simultaneous movement and action in the S. L. S. Locking System is accomplished (FIG. 2) with all multiple internal spring loaded lock mechanisms.

When the doorknob is compromised (FIG. 9) the S. L. S. mechanisms (FIG. 10) will remain locked in place (FIG. 11). The wire connectors between the internal spring loaded bolt locks and the S. L. S. door knob mechanism (FIG. 9) will be broken by force. The steel connecting wires once separated from the S. L. S. doorknob mechanism and their respective internal spring loaded bolt locks cannot be re-attached. The locked position of the S. L. S. mechanism (FIG. 11) cannot be unlocked manually because the connecting wires (FIG. 9) are unreachable by the intruder.

When the doorknob is compromised by force, (FIG. 9) adverse pressure is applied to the mechanism and its connections. An incorporated "weak-link" (FIG. 9) is built into the connecting wires. (FIG. 10) This part (FIG. 10) is made from a softer and weaker metal (brass) as compared to the (steel) connecting wires (FIG. 10) which "connect" the S. L. S. internal spring loaded bolt locks to the S. L. S. doorknob mechanism. (FIG. 9) When compromising force is applied to the S. L. S. doorknob mechanism, (FIG. 9) the connecting wires (FIG. 9) will separate at the "weak-link" (FIG. 9) and disconnect the attachment to the S. L. S. internal spring loaded bolt locks (FIG. 10) and the S. L. S. doorknob mechanism (FIG. 9). When this separation occurs, the internal spring loaded bolt locks (FIG. 11) will remain in the "locked" position (FIG. 11) by way of the internal springs within the bolt mechanism, (FIG. 11) providing continued force upon their respective bolt locks within the mechanism. (FIG. 11) This "locked" position of the door within its frame (FIG. 11) cannot be reversed manually or otherwise because of the disconnection of the two mechanisms (FIG. 9) within the system and door.

BRIEF DESCRIPTION OF THE SEVERAL VIEWS OF THE DRAWINGS

Drawing

(FIGS. 1, 2, 3, 4, 5, 6, 7, 8, 9, 10, 11, 12 & 13) incorporate the Kwikset tubular locking cylinder in its operation and function. The views of the drawings show the different parts utilized in the process and application of the invention.

FIG. 1—Skiles Locking System mechanism incorporated into Kwikset tubular locking cylinder.

FIG. 2—Internal spring loaded sliding bolts

FIG. 3—S. L. S. door locking mechanism (open)

FIG. 4—Internal spring loaded connecting rods, connecting wires, brass end cap, and brass face plate FIG. 5—Multiple internal spring loaded bolt door (closed & locked, open & unlocked position)

FIG. 6—Internal spring loaded sliding bolts steel sleeve

FIG. 7—Brass containment cylinder

FIG. 8—Brass containment face plate

FIG. 9—S. L. S. Door Knob Mechanism (Compromised)

FIG. 10—S. L S. Rotating Disc (8, 9) "Weak-link" connectors unbroken FIG. 11—S. L. S. Internal locking system bolt mechanism (Locked position within door frame.)

FIG. 12—S. L. S. Rotating disc (8, 9) "Weak-link" connection broken

FIG. 13—S. L. S. Internal Locking System Bolt Mechanism (unlocked position within door and frame)

DETAILED DESCRIPTION OF THE INVENTION

Figure 9:
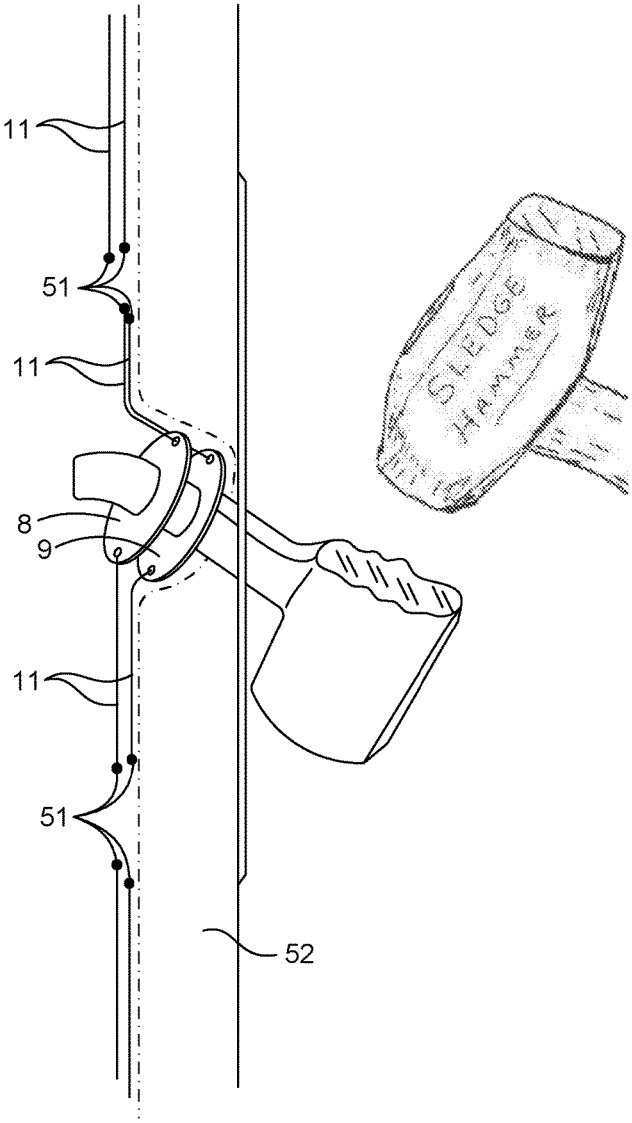

1. Internal spring loaded bolt locks are simultaneously activated by a key, button or remote electronic device.
2. When the doorknob mechanism is compromised, (FIG. 9) the internal locking mechanisms will remained locked in place.
3. The S. L. S. locking mechanism with the internal spring loaded bolt locks are completely contained within a brass cylinder within the door.

SEQUENCE LISTING

Figure 1:
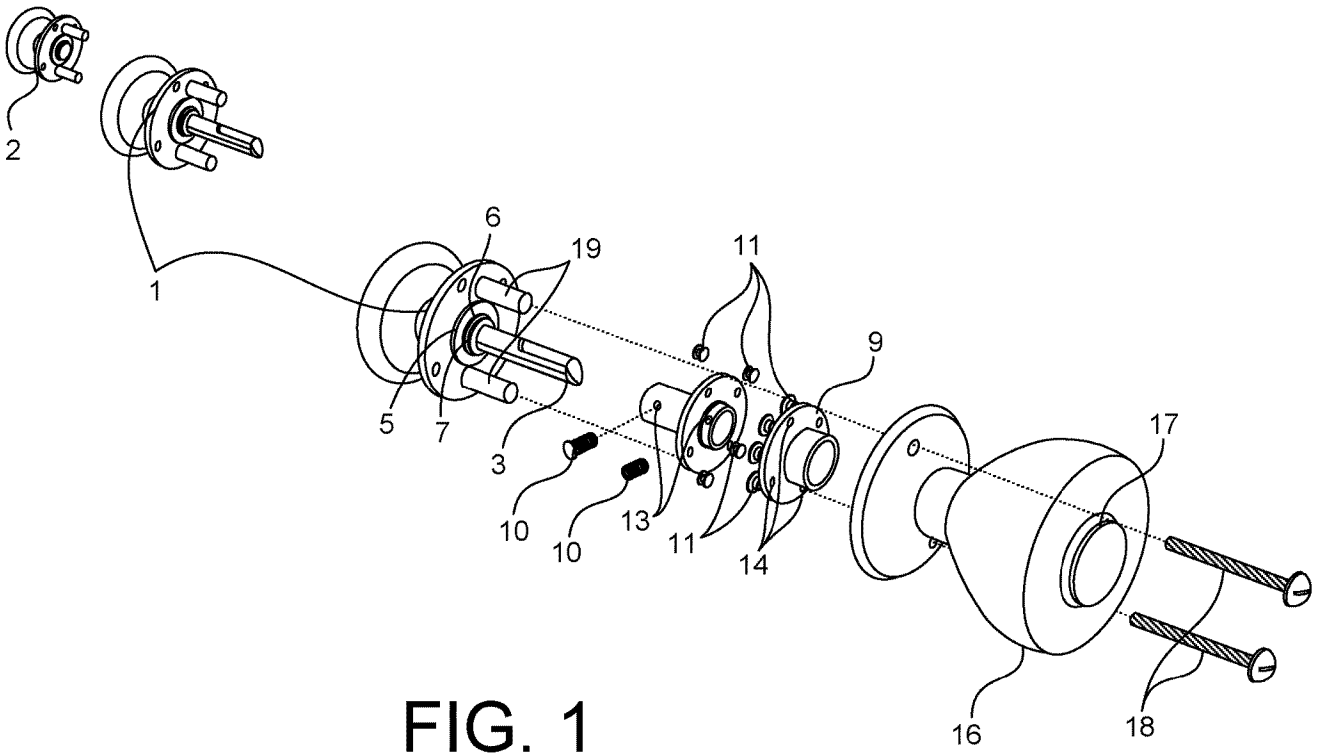
FIGS. 1, 2, 3, 4, 5, 6, 7, 8, 9, 10, & 11 depict the utilization of the prior art of the Kwikset tubular locking cylinder (FIG. 1) with the S. L. S. Locking System.
Figure 2:
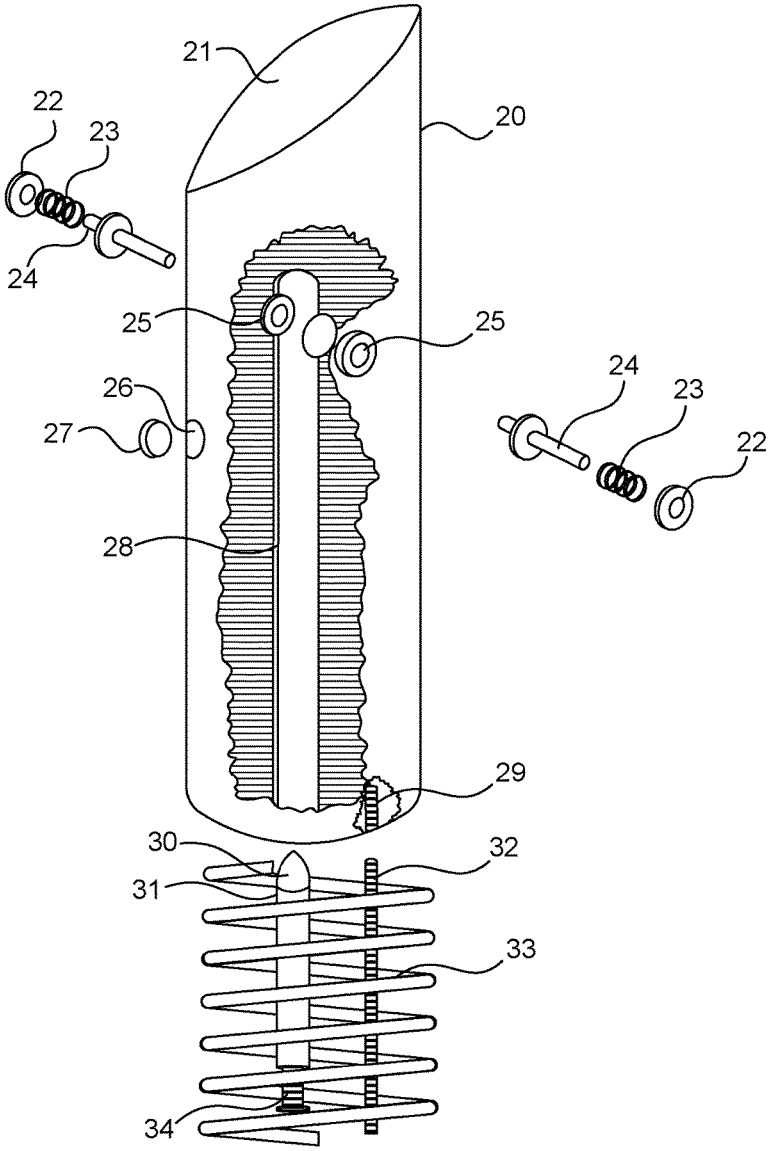
Figure 3:
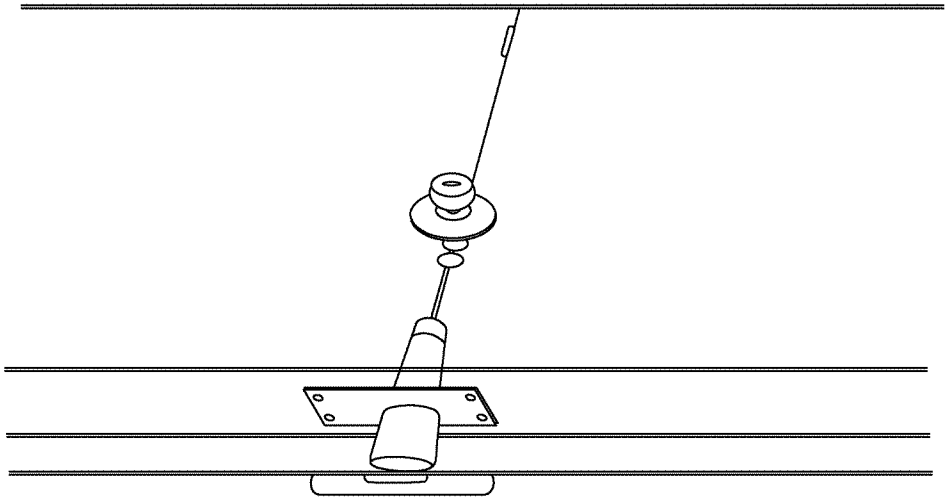
Figure 4:
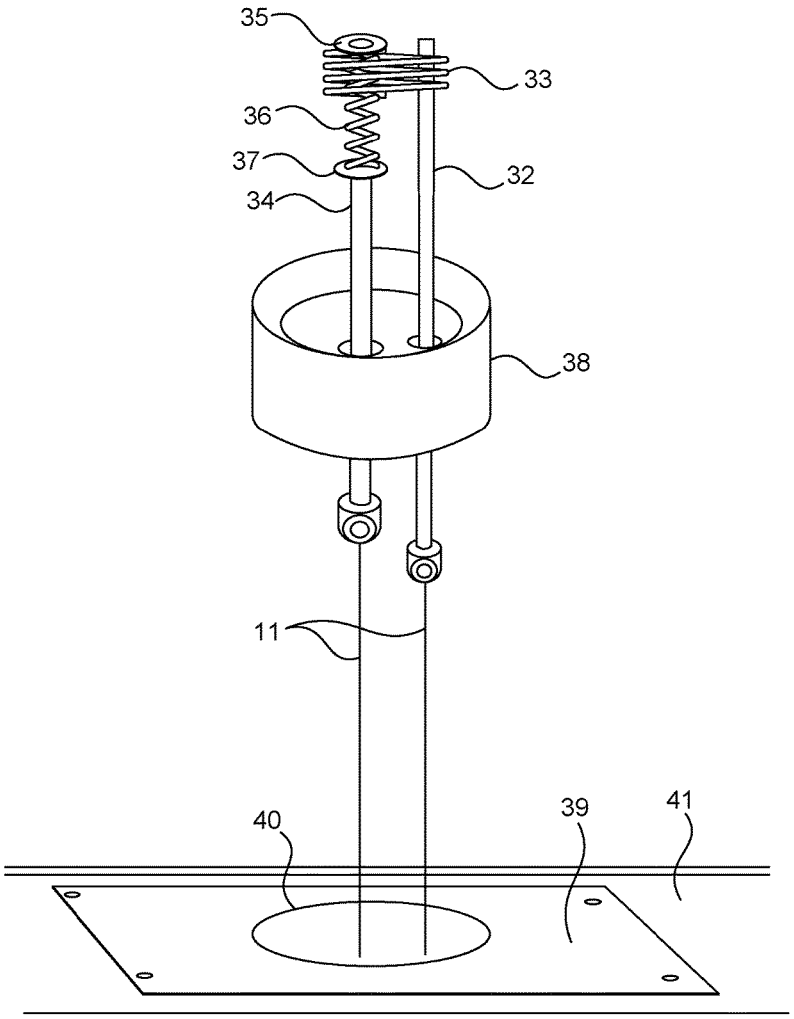
Figure 5:
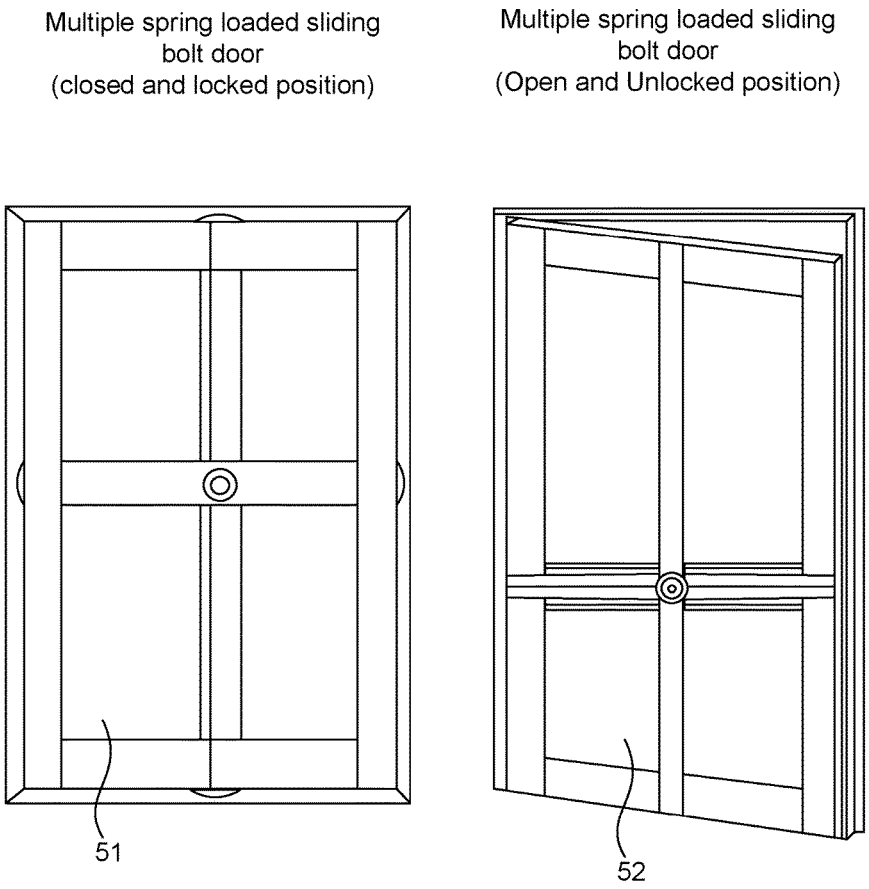
Figure 6:
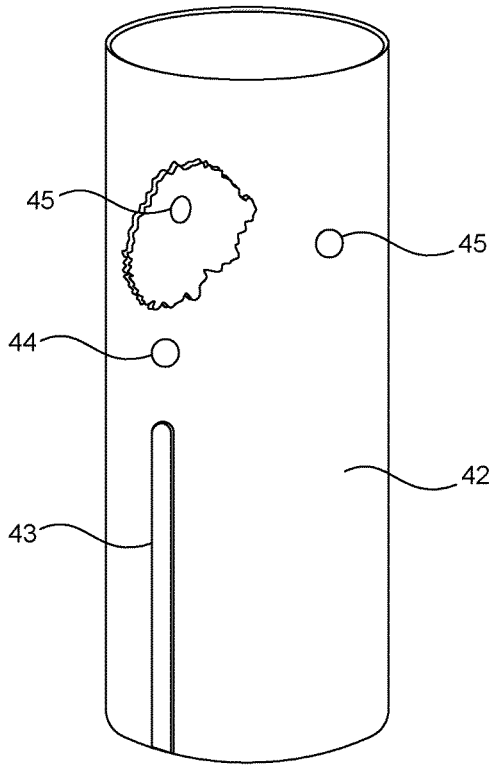
Figure 7:
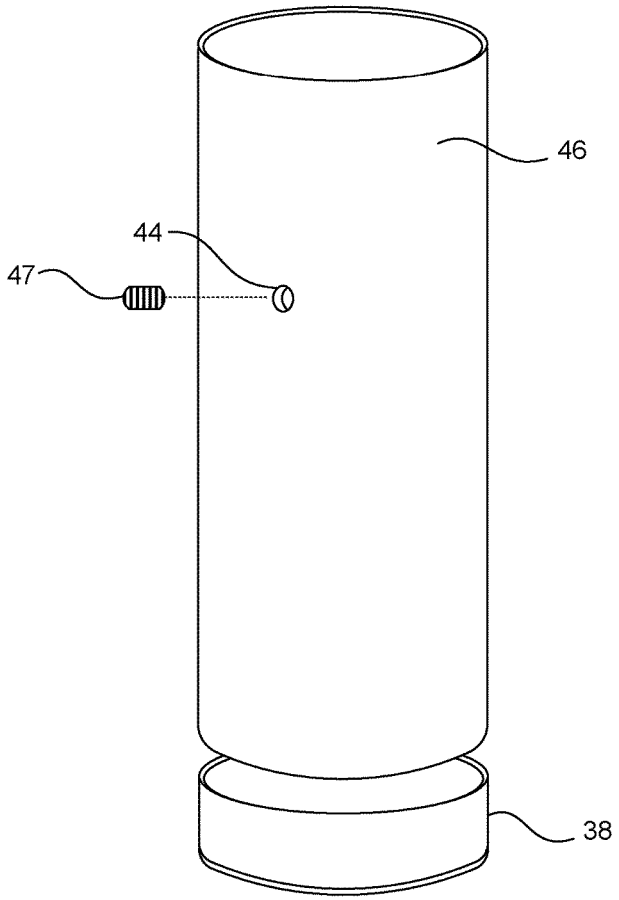
Figure 8:
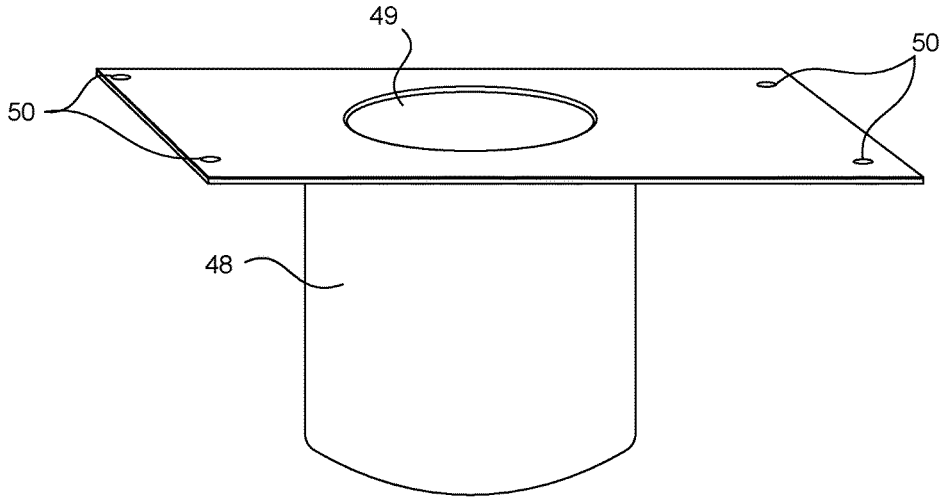
Figure 10:
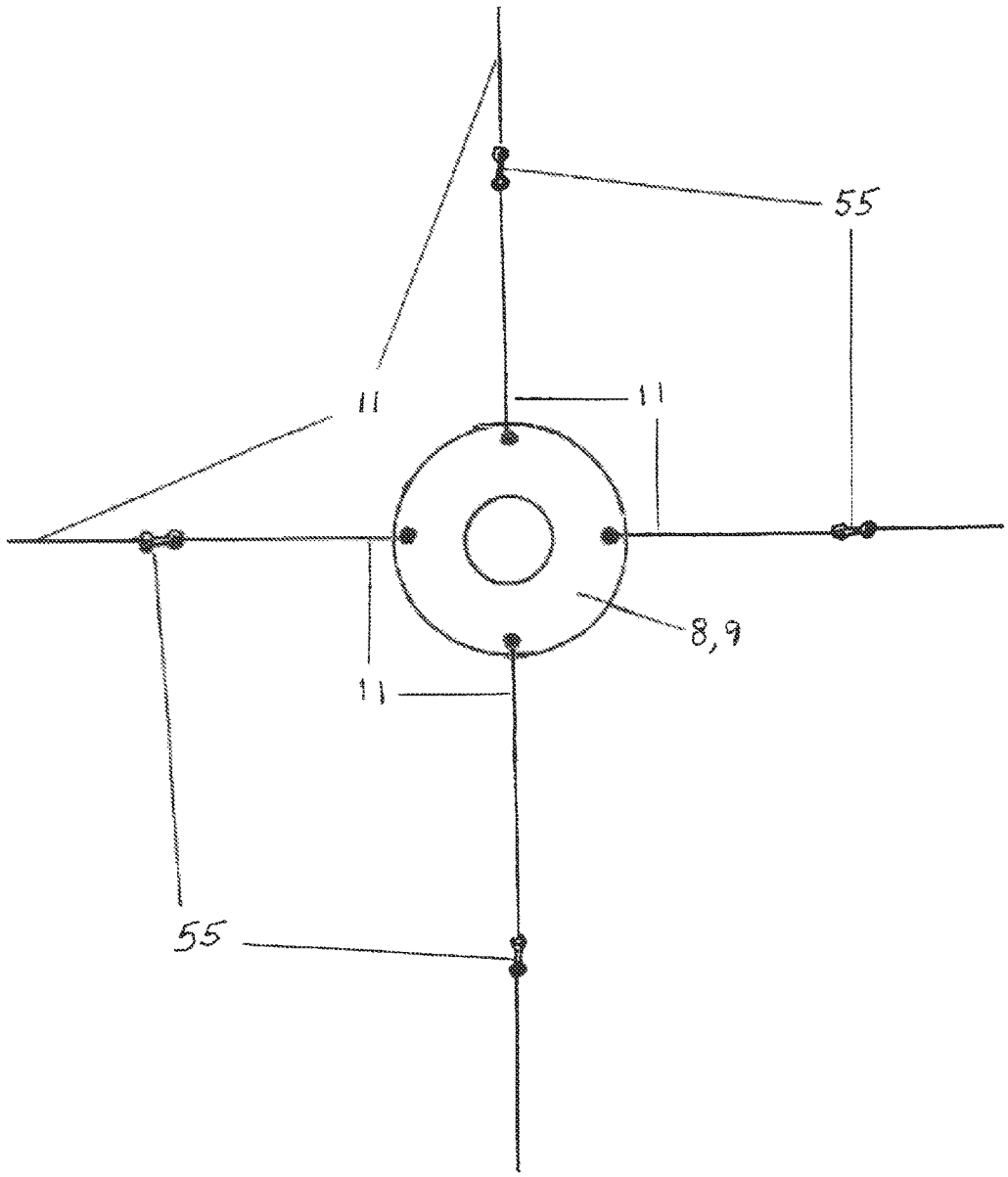
Figure 11:
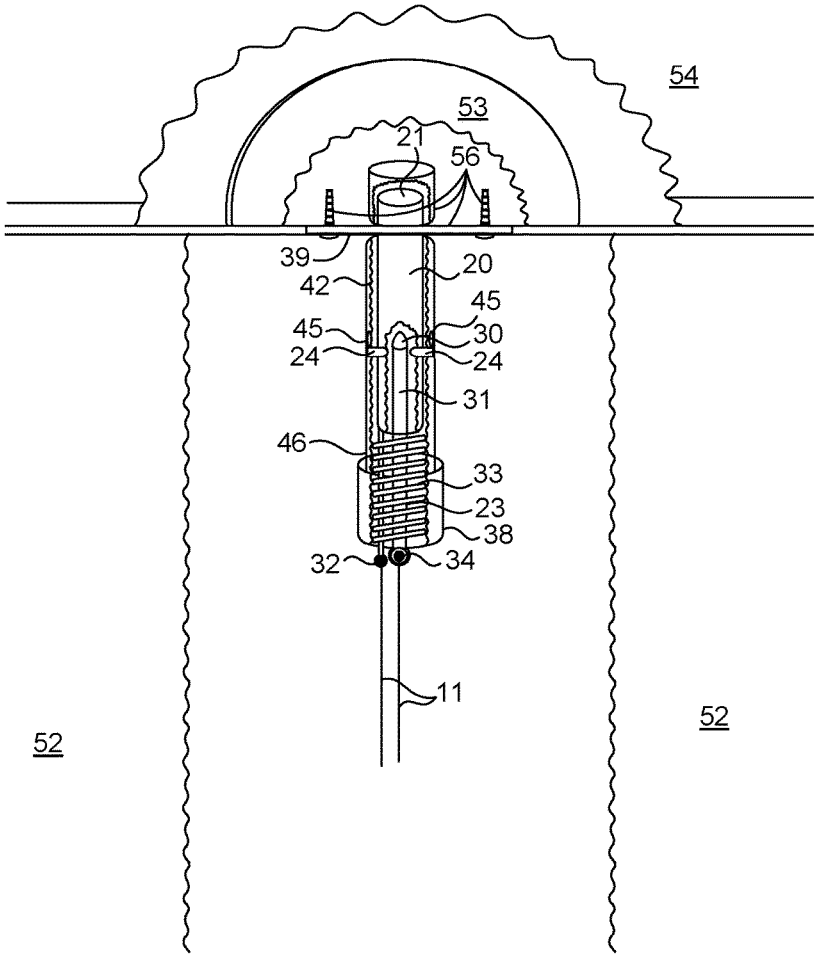

FIG. 1 Skiles Locking System Mechanism
1. Kwikset tubular locking cylinder
2. Locking tumbler set (key or "electronic keyless")
3. Kwikset rotating half-shaft
4. Kwikset round spindle
5. Kwikset locking mechanism
6. Locking spindle assembly—Kwikset
7. Locking spindle assembly—Kwikset
8. S. L. S. rotating disc for internal spring loaded floating locks
9. S. L. S. rotating disc for internal spring loaded sliding bolts
10. Attachment screws (floating lock disc to round spindle (4)
11. Steel connecting wires
12. Brass screws, Brass washers
13. Threaded connecting holes (attachment screws) (10)
14. Threaded connecting holes (attach steel connecting wires) (11)
15. Threaded connecting holes (attach steel connecting wires) (11)
16. Interior doorknob
17. Button lock
18. Connecting bolts (inside doorknob to outside doorknob assembly)
19. Connecting bolts (18) threaded base
FIG. 2 Internal spring loaded sliding bolts
20. Internal spring loaded sliding bolt
21. Beveled face
22. Floating lock retaining ring
23. Internal floating lock spring
24. Internal floating lock pin
25. Horizontal floating lock shaft access
26. Ball bearing
27. Ball bearing retaining hole
28. Floating lock separator pinion access hole
29. Threaded hole (for sliding bolt connecting rod (32)
30. Tapered point of separator pinion
31. Separator pinion
32. Sliding bolt connecting rod (threaded)
33. Internal spring loaded sliding bolt spring
34. Separator pinion connecting rod (threaded)
FIG. 3 S. L. S. door locking mechanism (open)
FIG. 4 Internal spring loaded connecting rods, connecting wires, brass end cap, and brass face plate
11. Steel connecting wires
32. Internal spring loaded sliding bolt connecting rod
33. Internal spring loaded sliding bolt spring
34. Internal floating lock separator pinion connecting rod
35. Separator pinion spring tension nut
36. Floating lock separator pinion spring
37. Separator pinion spring retaining washer
38. Brass end cap (attaches to brass containment cylinder)
39. Brass face plate mounting surface on door (mortised)
40. Drilled access hole for spring loaded sliding bolt assembly in door
41. Door edge
FIG. 5 Multiple internal spring loaded bolt door (closed & locked, open & unlocked position)
51. Multiple internal spring loaded sliding bolt door (closed and locked position)
52. Multiple internal spring loaded sliding bolt door (open and unlocked position)
FIG. 6 Internal spring loaded sliding bolts steel sleeve
42. Internal spring loaded sliding bolt steel sleeve
43. Alignment groove for ball bearing (26)
44. Alignment screw hole—threaded for brass containment cylinder alignment screw (47)
45. Internal spring loaded floating lock locking holes
FIG. 7 Brass containment cylinder
38. Brass containment cylinder end cap
44. Alignment screw hole—threaded for spring loaded sliding bolt steel sleeve
46. Brass containment cylinder
47. Steel sleeve alignment screw
FIG. 8 Brass containment face plate
48. Brass containment face plate
49. Sliding bolt access hole
50. Face plate holes for door application
FIG. 9 S. L. S. Door Knob Mechanism (Compromised)
8,9. S. L. S. rotating discs
11. Steel connecting wires
51. "Weak-link" connectors broken (by force)
52. Door
FIG. 10 S. L. S. Rotating Disc (8,9)
11. Steel connecting wires
55. "Weak-link" connectors
FIG. 11 S. L. S. Internal locking system bolt mechanism (Locked position within door frame.)
11. Steel connecting wires
20. Internal spring loaded sliding bolt
21. Beveled face
23. Internal floating lock spring
24. Internal floating lock pin
30. Tapered point of separator pinion

Figure 12:
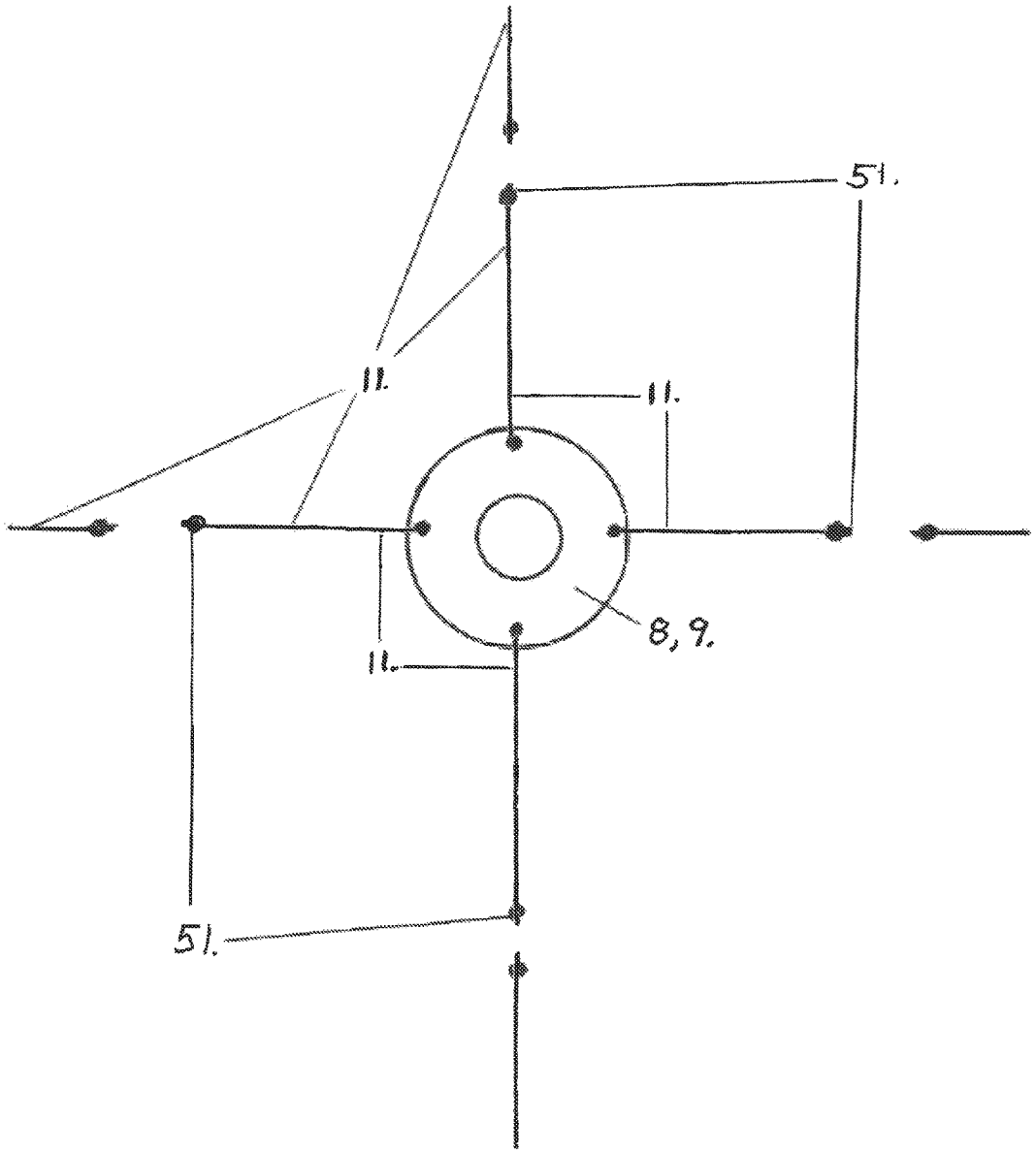

31. Separator pinion
32. Internal spring loaded sliding bolt connecting rod
33. Internal spring loaded sliding bolt spring
34. Internal floating lock separator pinion connecting rod
38. Brass end cap (attaches to brass containment cylinder)
39. Brass face plate mounting surface on door (mortised)
42. Internal spring loaded sliding bolt steel sleeve
45. Internal spring loaded floating lock locking holes
46. Brass containment cylinder
52. Door
53. Steel insertion plate
54. Door frame
56. Strike plate and screws FIG. 12 S. L. S. Rotating disc (8,9)
11. Steel connecting wires (separated)
51. "Weak-link" connectors (broken by force)

Figure 13:
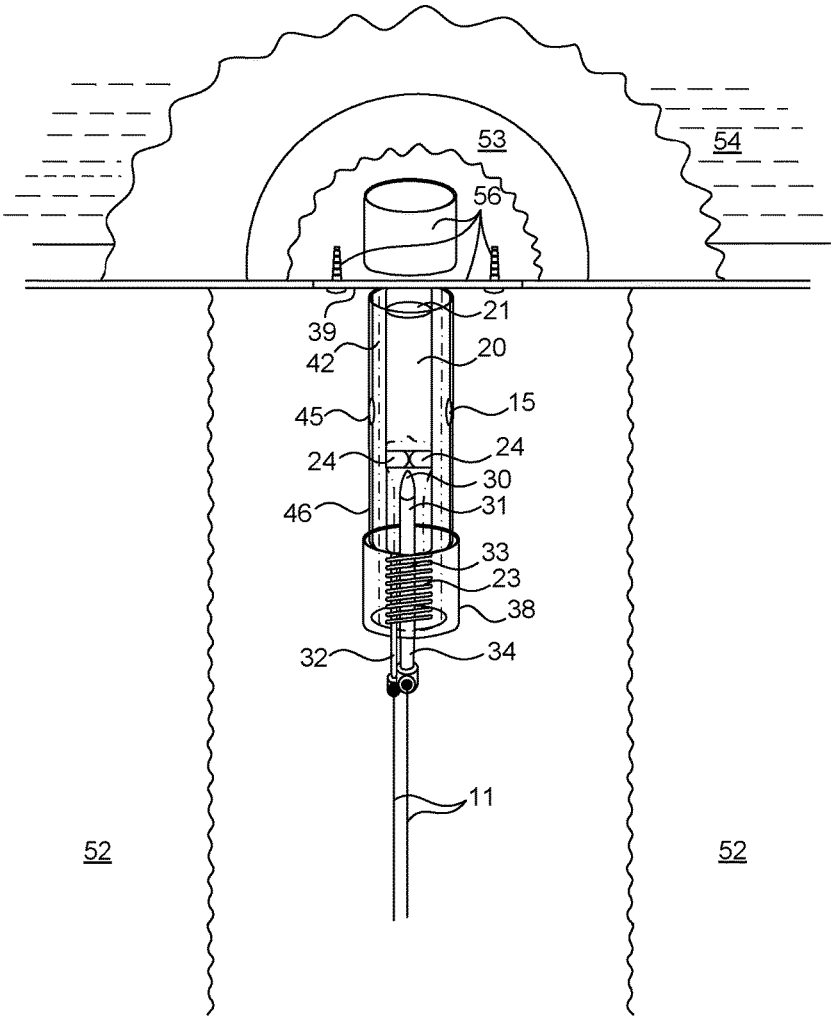

FIG. 13. S. L. S. Internal Locking System Bolt Mechanism (unlocked position within door and frame)
11. Steel connecting wires
20. Internal spring loaded sliding bolt
21. Beveled face
23. Internal floating lock spring
24. Internal floating lock pin
30. Tapered point of separator pinion
31. Separator pinion
32. Internal spring loaded sliding bolt connecting rod
33. Internal spring loaded sliding bolt spring
34. Internal floating lock separator pinion connecting rod
38. Brass end cap (attaches to brass containment cylinder)
39. Brass face plate mounting surface on door (mortised)
42. Internal spring loaded sliding bolt steel sleeve
45. Internal spring loaded floating lock locking holes
46. Brass containment cylinder
52. Door
53. Steel insertion plate
54. Door frame
56. Strike plate and screws

The invention claimed is:

1. A device comprising:

a doorknob, said doorknob comprising, at least one of, an interior doorknob with a button lock and an exterior doorknob, wherein said doorknob is configured to install on a surface of a door;

a first rotating disc implement, in which said first rotating disc is coupled to said interior doorknob;

a first steel connecting wire, wherein one proximate end of said first steel connecting wire is into engagement with said first rotating disc implement, while an other proximate end of said first steel connecting wire is into engagement with a first connecting rod;

wherein said first connecting rod comprises at least a spring loaded sliding bolt connecting rod configured to engage a threaded hole of a sliding bolt, wherein said first connecting rod is into engagement with the other proximate end of said first steel connecting wire;

a second rotating disc implement, wherein said second rotating disc implement is generally coupled to said exterior doorknob;

a second steel connecting wire, wherein one proximate end of said second steel connecting wire is into engagement with said second rotating disc implement, while an other proximate end of said second steel connecting wire is into engagement with a second connecting rod;

wherein said second connecting rod comprises at least a separator pinion connecting rod configured to engage a separator pinion in said sliding bolt, wherein said second connecting rod is into engagement with the other end of said second steel connecting wire;

a first weak-link connector, wherein said first weak-link connector is disposed on a proximate middle portion of said first steel connecting wire, and wherein said first weak-link connector is configured to disable said first steel connecting wire when an excessive force is applied to said doorknob;

a second weak-link connector disposed on a proximate middle portion of said second steel connecting wire, wherein said second weak-link connector is configured to generally disable said second steel connecting wire when an excessive force is applied to said doorknob;

wherein said sliding bolt is into engagement with said spring loaded sliding bolt connecting rod and said separator pinion connecting rod, wherein said sliding bolt comprising at least a spring loaded sliding bolt operable to enable said device to position in a locked or unlocked condition;

a spring loaded sliding bolt steel sleeve, wherein said spring loaded sliding bolt steel sleeve is configured to envelope said sliding bolt;

a brass containment cylinder, wherein said brass containment cylinder is configured to generally contain said sliding bolt; and a brass end cap, wherein said brass end cap is configured to attach at a proximate end of said brass containment cylinder.

2. The device of claim 1, in which said first and second weak-link connector comprises a softer and weaker metal as compared to said first or second steel connecting wire.

3. The device of claim 1, further comprising a brass containment face plate, wherein said brass containment face plate comprising a sliding bolt access hole that is configured to accept said sliding bolt.

4. The device of claim 3, further comprising a sliding bolt spring, wherein said sliding bolt spring is configured to spring load said sliding bolt.

5. The device of claim 4, further comprising a floating lock pin, wherein said floating lock pin comprising at least a first floating lock pin and at least a second floating lock pin.

6. The device of claim 5, further comprising at least a separator pinion into engagement with said separator pinion connecting rod.

7. The device of claim 6, in which said sliding bolt further comprising a floating lock separator pinion access hole, wherein said floating lock separator pinion access hole is configured to couple with said separator pinion.

8. The device of claim 7, in which said sliding bolt further comprising at least a threaded hole that is configured to couple with said spring loaded sliding bolt connecting rod.

9. The device of claim 8, further comprising at least a sliding bolt steel sleeve.

10. The device of claim 9, in which said sliding bolt steel sleeve comprising at least an alignment groove for a ball bearing.

11. The device of claim 10, further comprising at least a brass containment cylinder.

12. The device of claim 11, further comprising at least a floating lock separator pinion spring, wherein said floating lock separator pinion spring is disposed proximately between said separator pinion and said separator pinion connecting rod.

13. The device of claim 1, further comprising at least a brass containment face plate.

14. A device consisting essentially of:

means for securing a door to a door frame;

means for activating an unlocking of said device;

means for activating a locking of said device;

means for supporting said activating means;

means for positioning said device in said unlocking condition;

means for positioning said device in said locking condition;

means for guiding said positioning means is said unlocking and locking condition;

means for providing a spring loading action of said position means;

means for coupling said activating means and said positioning means; and means for disabling said coupling means, wherein said disabling means is disposed on a portion of said coupling means, and wherein said disabling means is configured to break said coupling means upon said doorknob being broken by force.

15. The device of claim 14, further consisting essentially of means for accepting said positioning means.

16. A device comprising:

a doorknob, said doorknob comprising, at least one of, an interior doorknob with a button lock and an exterior doorknob, wherein said doorknob is configured to install on a surface of a door;

a first rotating disc implement, wherein said first rotating disc implement is coupled to said interior doorknob;

a first steel connecting wire, wherein one proximate end of said first steel connecting wire is into engagement with said first rotating disc implement;

a second rotating disc implement, wherein second rotating disc implement is coupled to said exterior doorknob;

a second steel connecting wire, wherein one proximate end of said second steel connecting wire is into engagement with said second rotating disc implement;

a first connecting rod, wherein said first connecting rod is configured to generally couple to other proximate end of said first steel connecting wire, wherein said first connecting rod comprises a spring loaded sliding bolt connecting rod;

a second connecting rod, wherein said second connecting rod is configured to couple to other proximate end of said second steel connecting wire, wherein said second connecting rod comprises a separator pinion connecting rod;

a sliding bolt, wherein said sliding bolt is into engagement with said spring loaded sliding bolt connecting rod and said separator pinion connecting rod, in which said sliding bolt comprising a spring loaded sliding bolt that is operable to enable said device to position in a locked or unlocked condition;

a weak-link connector being disposed on a proximate middle portion of said first steel connecting wire and said second steel connecting wire, wherein said weak-link connector is configured to disable said first steel connecting wire and said second steel connecting wire upon an excessive force applied to said doorknob; and wherein said weak-link connector comprises at least a softer and weaker metal as compared to said first or second steel connecting wire, wherein said weak-link connector is configured to break upon said doorknob being broken by force, thereby breaking said first and second steel connecting wire;

a spring loaded sliding bolt steel sleeve, wherein said spring loaded sliding bolt steel sleeve is configured to envelope said sliding bolt;

a brass containment cylinder, wherein said brass containment cylinder is configured to generally contain said sliding bolt; and a brass end cap, wherein said brass end cap is configured to attach at a proximate end of said brass containment cylinder.

17. The device of claim 16, further comprising;

a brass containment face plate, wherein said brass containment face plate comprising at least a sliding bolt access hole, and wherein said sliding bolt access hole is configured to accept said sliding bolt;

a sliding bolt spring configured to spring load said sliding bolt;

a floating lock pin, wherein said floating lock pin comprising at least a first floating lock pin and a second floating lock pin;

a separator pinion joined to said separator pinion connecting rod; and a floating lock separator pinion spring disposed between said separator pinion and said separator pinion connecting rod.

* * * * *